United States Patent [19]

Rodda

[11] Patent Number: 4,856,290

[45] Date of Patent: Aug. 15, 1989

[54] REFRIGERANT RECLAMATION SYSTEM

[76] Inventor: Richard K. Rodda, 2906 Tarragon La., Bowie, Md. 20715

[21] Appl. No.: 224,361

[22] Filed: Jul. 26, 1988

[51] Int. Cl.[4] ..... F25B 45/00

[52] U.S. Cl. ..... 62/149; 62/292

[58] Field of Search ..... 62/292, 149, 174, 195, 62/500

[56] References Cited

U.S. PATENT DOCUMENTS 3,071,935 1/1963 Kapeker ..... 62/155

3,357,197 12/1967 Massengale ..... 62/195

4,539,817 9/1985 Staggs et al. ..... 62/292 X 4,646,527 3/1987 Taylor ..... 62/292 X

*Primary Examiner*—Henry A. Bennet

*Assistant Examiner*—John Sollecito

*Attorney, Agent, or Firm*—Eli Lieberman

[57] ABSTRACT

An on-site refrigerant reclamation system connectable to an operating refrigeration or air conditioning installation periodically removes small batches of the contaminated refrigerant to separate out the contaminants. A storage tank provided with an electric heater receives the contaminated refrigerant and through a distillation process drives off the refrigerant in a pure state and returns it to the installation. A control system is provided to enable automatic operation.

15 Claims, 2 Drawing Sheets

REFRIGERANT RECLAMATION SYSTEM

BACKGROUND OF THE INVENTION

This invention relates to a portable on-site refrigerant reclamation system which can be coupled to an operating refrigeration installation to remove undesirable contaminants.

The performance and operating life of a refrigeration system can be adversely affected by the presence of contaminants. The chief contaminants are oil, rust, moisture, acids, sludge, and metal particles.

It has been the general practice up to now to dump the entire refrigerant charge in a contaminated system and to start over again with a new charge. Not only is this practice wasteful of refrigerant, but concern has developed in recent years that certain fully halogenated refrigerants can accumulate in the atmosphere and contribute to the "greenhouse effect" as well as possibly affecting the ozone layer. Efforts are under way to reduce emissions of fully halogenated refrigerants by recycling contaminated refrigerants.

One approach involves placing the contaminated refrigerant in drums and shipping them to a centrally located processing plant where the refrigerant can be reclaimed. The advantage here is that the chemical purity of the reclaimed refrigerant can be better controlled. The disadvantage is in the high labor and shipping costs in handling the refrigerant.

Another approach involves on-site reclamation where the contaminated refrigerant is purified on the job and returned to the system.

The invention disclosed here is directed to an on-site reclamation system hermetically coupled to a refrigeration installation to reclaim the refrigerant without interfering with its normal mode of operation.

SUMMARY OF THE INVENTION

It is an object of the invention to provide a portable on-site refrigeration reclamation unit which can be readilly attached to a refrigeration system for the purpose of removing contaminants. Batches of the working fluid are periodically removed from the system and caused to flow into a tank. A heater mounted within the tank separates the pure refrigerant from the contaminated solution by a distillation process.

Another object of the invention is to use refrigeration oil as a scavenging agent to trap and hold in solution moisture and metallic particles which enter the reclamation tank.

Another object of the invention is to design a reclamation system which is adaptable to a wide variety of refrigerants and which is provided with a flexible control system including alternate modes of operation.

DETAILED DESCRIPTION OF THE PREFERRED EMBODIMENT

Figure 1:
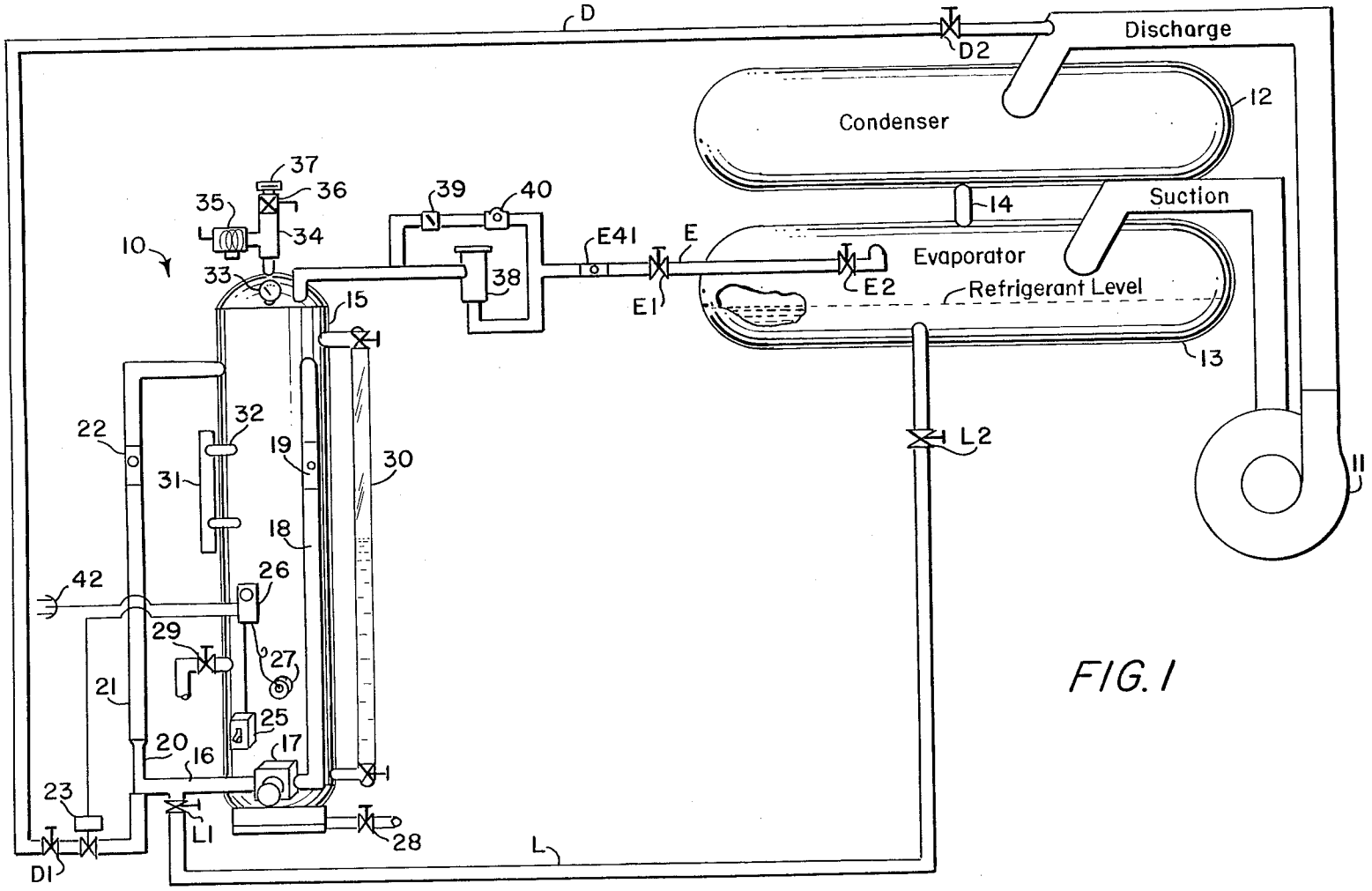
FIG. 1 is a schematic view showing the refrigerant reclamation system connected to a typical chiller.

FIG. 1 of the drawing shows the novel refrigerant reclamation system 10 of the invention connected to a conventional chiller comprising a compressor 11, a condenser 12, and an evaporator 13. The compressor 11 operates in conventional fashion to lower the pressure in evaporator 13 causing the liquid refrigerant therein to boil away, lowering temperature. A heat exchanger, not shown, is mounted within the evaporator and a fluid is circulated therein to be chilled for conditioning air of for some other industrial process.

The refrigerant vapor entering the compressor is discharged at elevated pressure and temperature into the condenser 12 where it condenses upon the surfaces of a heat exchanger, not shown, carrying circulating cooling water. The condensed refrigerant collects at the bottom of condenser 12 and is returned to evaporator 13 through a metering device shown at 14 to complete the cycle.

Although shown associated with a conventional chiller using R11 or R113 refrigerant, it should be understood that the refrigerant reclamation system disclosed here is adaptable to most large tonnage refrigeration systems using a wide variety of refrigerants.

Access to the chiller is gained by means of three shutoff valves D2, E2, and L2, mounted closely to the chiller on access ports generally available for servicing and special applications.

Valve D2 is connected to the discharge line from the compressor 11 to the condenser 12 and when opened allows discharge gas to flow to the reclamation unit. Valve E3 is connected to a top portion of the evaporator 13 well above the maximum liquid level and when opened allows the return of processed refrigerant vapor to the evaporator 13 from the reclamation unit. Valve L2 is connected to the bottom of the evaporator and when opened allows liquid refrigerant to flow into the reclamation unit.

Corresponding shutoff valve D1, E1 and L1 are mounted on the reclamation unit. The respective valve sets are interconnected with suitable piping D, E, and L, respectively, which can be disconnected at the valves to facilitate installation and removal.

The reclamation unit 10 comprises a tank 15 designed to withstand the pressure of the particular application and bearing the approval of applicable safety codes. A typical tank will hold some 40 gallons, but tank size can vary with the particular application.

The outlet of shutoff valve L1 feeds a tee fitting 16 having one side connected to a liquid feed pump 17 mounted on the base of the tank. The outlet of pump 17 is connected to a liquid feed line 18 which discharges into an upper portion of tank 15. A feed pump sight glass 19 is mounted in the liquid feed line 18 to give a visual indication of liquid flow. When valves L1 and L2 are opened and the pump is placed in operation, liquid refrigerant will be pumped from evaporator 13 and discharged into tank 15. The feed pump 17 discharges into a top portion of the tank to prevent back syphoning of liquid to the evaporator when the feed pump is stopped.

The other side of tee fitting 16 is connected to the liquid inlet of a jet pump 20. The outlet of pump 20 is connected to a liquid feed line 21 which discharges into an upper portion of tank 15 at about the same level as line 18. A jet pump sight glass 22 is mounted in pipe 21 to monitor liquid flow. Pressurized gas to operate the jet pump 21 is supplied to the jet pump gas inlet by discharge line D. An electrically operated solenoid valve 23 is placed in discharge line D between shutoff valve D1 and the jet pump. With valves D2, D1, L2, L1 and solenoid valve 23 in the open position, discharge gas from the operating chiller will be conducted to the inlet of the jet pump where it will asperate liquid refrigerant from line L and blow it into tank 15.

Figure 2:
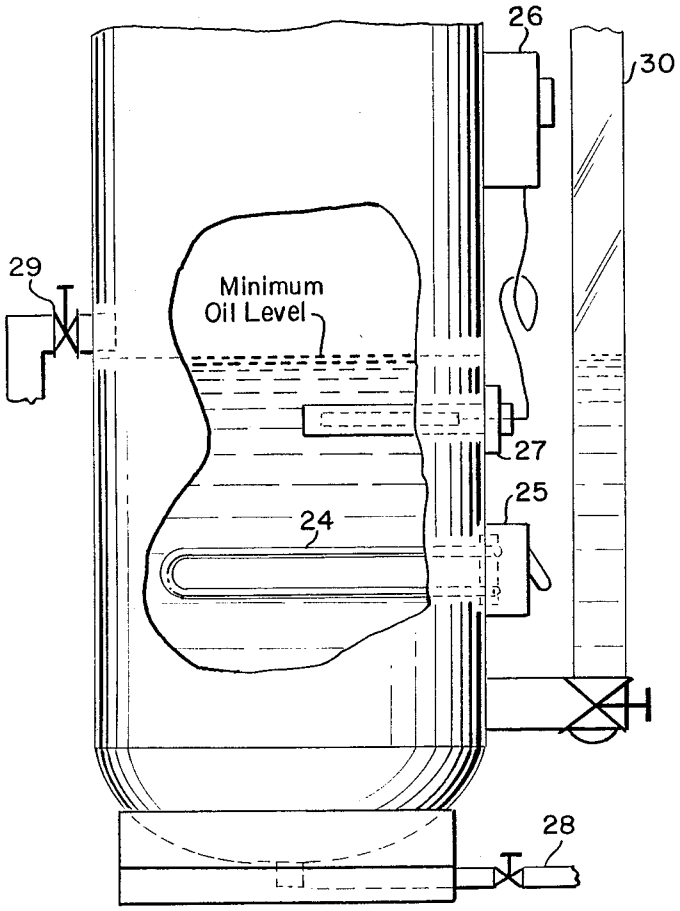
FIG. 2 is an enlarged schematic view of the lower portion of the reclamation tank showing the positioning of the parts.

As shown in FIG. 2, resistance heater 24 is mounted in a bottom portion of the tank 15 by means of a mounting housing 25. The electrical resistance heater 24 is energized by means of a single pole-double throw thermostatically controlled switch 26 mounted on the tank and having its sensing bulb 27 inserted into a well extending into the tank at a location slightly above the resistance heater.

A drain valve 28 is connected to the bottom of the tank 15 and when opened allows the liquid contents to drain out. Another level determining drain valve 29 is mounted above the drain valve 28 at a height to define a predetermined minimum liquid level in tank 15. This minimum liquid level is necessary to ensure that the electric heater 24 is always submerged in liquid when energized. The sensing bulb 27 for thermostat 26 is also mounted below the minimum liquid level so as to be always submerged in liquid.

A tank sight glass 30 is mounted on the side of the tank 15 extending from the bottom to a portion near the top. The purpose of the sight glass is to monitor the liquid level in the tank and to yield a color indication indicative of the quality of the mixture in the tank. A liquid level control switch 31 is mounted on tank 15 at a level below the discharge outlets of pipes 18 and 21. The liquid level control switch 31 is of a conventional type and controls the liquid level between two spaced ports 32 tapped into tank 15.

A pressure and vacuum gauge 33 is mounted on the tank to give a constant reading of tank pressure during operation. Also mounted on the tank top is a tap 34 with 2 ports. A pressure relief valve 35 is mounted on one side port. This relief valve protects the system from any excessive increase in pressure. A ball valve 36 is mounted on the top port of tap 34. The ball valve 36 can be used to draw a vacuum on the tank or for any other desirable servicing function. A plug 37 is mounted in the top port above ball valve 36 to seal the opening when not in use.

A filter-drier 38 is mounted in line E between shutoff valve E1 and the outlet of tank 15. The filter-drier aids in removing volatile and particulate contaminants which may have gotten by the distillation and scavenging processes in the reclamation tank. A pressure operated bypass valve 39 is mounted in parallel with the filter-drier 38 for the purpose of providing a path around the filter-drier in case it becomes clogged. Vapor flow can be monitored by means of bypass sightglass 40 and main line sight glass 41.

Figure 3:
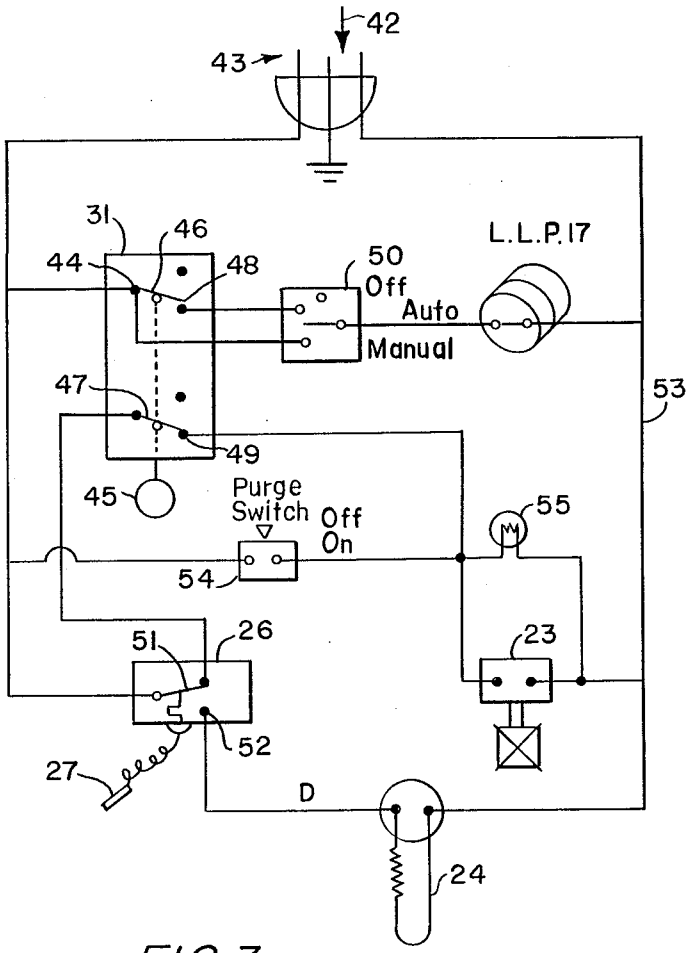
FIG. 3 is an electrical schematic of the control system.

The electrical control circuit for the reclamation tank 15 is shown in FIG. 3. It is preferred to treat the disclosed system as a portable appliance and provide a flexible cable with a three prong plug 42 insertable into a standard 120 volt wall outlet. However, the system can be designed to operate on most commercially available voltages. The energized or "hot" line 43 from the pin plug 42 is connected to switch terminal 44 of liquid level control 31 which includes a double pole single throw switch operated by float 45. In a low liquid level position float 45 falls and moves switches 46 and 47 into a circuit closing position with contacts 48 and 49. In a high liquid level position the float moves swutches 46 and 47 into an upper contact off position. The float switch operator is an insulated rod with a settable lost motion differential as known in the art to control the rise and fall of the liquid in the tank.

A 3-position manual liquid pump control switch 50 is in circuit between liquid level control switch 31 and liquid feed pump 17. In an "off" position, switch 50 opens the circuit between the pump 17 and switch 31 causing pump 17 to be inoperative. In an "auto" position a circuit is completed between terminal 48 and pump 17 to place the pump under control of the liquid level control switch 31. In a "manual" position the switch 31 is effectively bypassed and a circuit is completed between terminal 44 and the pump to place pump operation under manual control. In this position the liquid level in tank 15 is then controlled by manual operation of switch 50.

When pump control switch 50 is in the "off" position the liquid feed pump is inoperative and liquid transfer is under control of thermostat 26 and solenoid valve 23 which activates jet pump 20. Thermostat 26 connected to "hot" line 43 is of the adjustable type and make one contact 51 on a rise in temperature and another contact 52 on a drop in temperature. In the position shown in FIG. 3 thermostat 26 has made contact with terminal 51 to energize solenoid 23.

Switch 47 in liquid level control 31 is in series circuit relationship between thermostat 26 and solenoid 23. It serves the purpose of preventing overfilling of the tank 15 by the action of solenoid valve 23. Energization of solenoid 23 activates the jet pump 20 to asperate liquid refrigerant into tank 15. The relatively cool liquid refrigerant lowers the temperature in tank 15 as sensed by sensing bulb 27 to cause thermostat 26 to make contact 52. This action opens the circuit to solenoid 23 terminating operation of the jet pump and placing the resistance heater across hot line 43 and neutral 53 to place the system on a heating cycle.

Purge switch 54 in parallel with thermostat 26 is for the purpose of energizing solenoid 23 to allow entry of discharge gas above the liquid in tank 15 for purging purposes as explained below.

OPERATIONAL DESCRIPTION

The refrigeration reclamation unit is placed near the evaporator and condenser of the centrifugal chiller and suitably piped between valves D1, E1, and L1 of the reclamation unit and corresponding valves D2, E2, and L2 of the chiller.

With valves D2, E2, L2, 28 and 29 closed plug 37 is removed, ball valve 36 opened, and refrigerant grade oil is poured into the tank unitl it reaches the level of drain valve 29. The initial charge of oil is necessary to ensure that the heater 24 is immersed in liquid so that it does not overheat and cause a breakdown of refrigerant and entrained oil. The oil also acts as a scavenger and absorbs and traps moisture and other pollutants in the system.

A vacuum pump is then connected to the outlet of ball valve 36. Valves D2, E2, L2, 28 and 29 remain closed while valves D1, E1, and L1 are opened. Switch 50 is placed in the "off⇄ position to prevent the liquid feed pump 17 from operating. Purge switch 54 is closed to energize solenoid 23 to place line D in the vacuum circuit. Electric plug 42 is inserted in a wall outlet and the solenoid 23 opens. Depending upon the temperature of the oil, the heater may go on but with an oil charge in place the heat will be safely absorbed. The vacuum pump is started and the entire system evacuated to a deep vacuum to remove all air and noncondensables. The vacuum pump is then removed and the ball valve 36 closed and capped.

Valve D1 is closed and valves D2, E2, and L2 are now opened to connect the chiller to the reclamation unit. Switch 50 is placed in the "auto" position to energize liquid pump 17. When pump 17 is used the chiller is not in operation as discharge gas is not needed to transfer the liquid. As relatively cool liquid pumped into tank 15 the temperature at the sensing bulb 27 drops and thermostat 26 makes contact 52 to energize the heater 24. The pump 17 continues to run until the liquid level rises to the upper port 32 of liquid level control 31 when pumping operation is terminated. Liquid entering the tank can be observed in sight glass 19 and tank sight glass 30.

The heat generated by heater 24 raises the temperature of the oil-refrigerant solution and the lower boiling point refrigerant is driven out of solution and leaves the tank at top outlet line E. Higher boiling point pollutants such as oil and water are left behind. Any liquid water present will settle out to the bottom of the tank and be covered with a layer of oil. Further purification is effected when the distilled refrigerant passes through filter-drier 38 which has a core tailored to absorb acids and some other trace pollutants. The purified refrigerant is returned to the relatively colder evaporator where it condenses as a liquid. The refrigerant is miscible with oil and as the refrigerant is distilled out of solution the level drops until the bottom port 32 is exposed and the pump 17 is again energized to fill the tank up to the upper port 32. The cycle is repeated every few hours as one charge of refrigerant after another is distilled and returned to the evaporator.

Every time a batch of refrigerant is distilled, some pollutants, mostly oil, are left behind, gradually raising the oil level in the tank. The number of refrigerant batches distilled before tank 15 becomes oil logged will depend upon the amount of pollutants in the evaporator. The onset of an oil logged condition will be indicated by an increase of tank temperature due to a lack of refrigerant to carry away the heat generated by heater 24. The temperature will rise to be about 50 degrees F above evaporator temperature, high enough to actuate thermostat 26 and make contact 51. Solenoid valve 23 will be energized along with indicating lamp 55. Inasmuch as valve D1 is closed, no discharge gas will flow through the solenoid valve.

Another indication of an oil logged condition is the color of the liquid in sight glass 30. With experience, the gradual change in color as the tank 15 fills with oil will be recognized.

When the tank 15 becomes oil logged, it must be drained. On R11 systems this is accomplished by closing valves L1 and E1 and opening valve D1. If solenoid 23 is not open as indicated by signal lamp 55, purge switch 54 is closed to energize solenoid 23. Discharge gas now fills the top of tank 15 raising the pressure above atmospheric. Valve 28 is first opened to drain any water and sludge which may have accumulated on the bottom of tank 15. The purging process is completed by opening valve 29 to drain the tank to the predetermined minimum oil level as set by the height of valve 29. This completes the basic purging operation and the reclamation system is reset to its normal distillation cycle.

If the chiller is not in operation on R11 systems, valves D1, E1 and L1 are closed and the temperatures and pressure are allowed to build up in the tank as observed on gauge 33. Whe sufficient pressure is developed, purging is accomplished by opening valves 28 and 29 as explained above.

On R113 systems it may not be possible to generate enough pressure to purge the oil logged tank. In this case, valves D1, E1, and L1 are closed and air is admitted through the ball valve 36. After the pollutants are drained, a vacuum is drawn on the tank to remove the air.

On systems employing such refrigerants as R12 and R22 with positive pressure characteristics at ambient temperatures, the pressure for purging is always available.

In R11 and R113 systems, if in doubt that enough refrigerant has been removed from solution during the distillation cycle, heat a measured sample of the pulluted solution to approximately 120 F and check to see if it decreases in volume. If the test sample does not decrease in volume, the polluted solution in the tank is ready to be removed and disposed of. If it does decrease in volume, permit the distillation process to run for another few hours.

In the jet pump mode of operation the chiller must be working and switch 50 placed in the off position to disable motor 17. Valves D1, E1, and L1 are in the open position and solenoid valve 23 is under control of thermostat 26. With the thermostat set at about 95 F to make contact 51, when that temperature is reached solenoid valve 23 is opened to permit discharge gas to activate the jet pump 20. Cool liquid from the evaporator is asperated into tank 15 where it mixes with the warm oil. When the solution temperature drops about 15 degrees F thermostat 26 makes contact 52 to energize heater 24. This cycle is repeated over and over again until the tank 15 becomes oil logged as indicated by a rising tank temperature and the color of the solution in sight glass 30. Once the tank becomes oil logged further continuation of the cycle is prevented through high limit contact 49 of the liquid level control 31 which breaks the circuit to solenoid valve 23.

After the refrigerant in the chiller has been restored to its proper level of purity, the reclamation unit may be left in place as a permanent filtering fixture, or else, may be removed and installed on another chiller where the refrigerant is known to be contaminated.

Although the invention has been described in connection with a chiller employing R11 and R113 refrigerant, it should be understood that it could be used on most refrigerants and all types of refrigeration and air conditioning installations including systems with a flooded evaporator or a low side liquid receiver.

What is claimed is:

1. A refrigerant reclamation system for on-site reclamation of contaminated refrigerant comprising an upright pressure vessel for holding a predetermined portion of the contaminated refrigerant, means for pumping said contaminated refrigerant into said vessel, said means for pumping comprising a liquid pump and a jet pump connected to a common liquid inlet for alternatively discharging contaminated refrigerant into said pressure vessel, a liquid level control means externally mounted on said vessel for controlling said pumping means to maintain a predetermined high and low liquid level in said vessel, an electric resistance heater mounted in a lower portion of said vessel in pressure tight relationship therewith; and a thermostatic switch means for controlling said resistance heater.

2. The apparatus of claim 1 wherein said pressure vessel is provided with a first drain valve connected to a bottom vessel portion and a second drain valve connected to a side vessel portion at a location to maintain a predetermined minimum liquid level to ensure that the resistance heater is always immersed in liquid.

3. The apparatus of claim 2 wherein a sight glass is provided along the side of the pressure vessel to visually monitor the liquid level and the color of the liquid therein.

4. The apparatus of claim 1 wherein said pressure vessel is connected to a refrigeration system with a 3-pipe system comprising a liquid line connected between the lower liquid containing portion of the refrigeration system evaporator and the inlet to said common liquid inlet, a discharge line connected between the discharge line of the refrigeration system and the inlet to the jet pump; and a vapor line connected between an upper portion of the refrigeration system evaporator and the top of said pressure vessel.

5. The apparatus as claimed in claim 4 wherein an electrically controlled solenoid valve is mounted in the discharge line on the inlet side of said jet pump.

6. The apparatus as claimed in claim 5 wherein a manually controlled purge switch is provided to manually energize said solenoid valve.

7. The apparatus as claimed in claim 5 wherein said solenoid valve is in electrical series relationship with said thermostatic switch means and said liquid level control means.

8. The apparatus as claimed in claim 1 wherein a 3 position manual control switch is mounted in a series circuit relationship between said liquid pump and said liquid level control means, said 3 position manual control switch comprising a first "off" position wherein said circuit between said liquid level control means and said pump is open, a second "auto" position wherein a circuit is completed between said liquid level control means and said pump; and a third "manual" position wherein said liquid level control means is bypassed to directly energize said liquid pump.

9. The apparatus as claimed in claim 4 wherein a filter-drier is provided in said vapor line at the outlet of said pressure vessel.

10. The apparatus as claimed in claim 1 wherein said thermostatic switch means has a sensing bulb mounted in said pressure vessel at a location above said resistance heater but below said liquid level determined by said second drain valve.

11. A refrigerant reclamation system for on-site reclamation of contaminated refrigerant comprising an upright pressure vessel for holding a predetermined portion of the contaminated refrigerant, liquid pump means for pumping said contaminated refrigerant into said vessel, a liquid level control means externally mounted on said vessel for controlling said pump means to maintain a predetermined high and low liquid level in said vessel, an electric resistance heater mounted in a lower portion of said vessel in pressure tight relationship therewith; and thermostatic switch means for controlling said resistance heater.

12. The apparatus of claim 11 wherein said liquid pump means comprises a jet pump.

13. The apparatus of claim 11 wherein said liquid pump means comprises a liquid pump and a jet pump.

14. The apparatus of claim 11 wherein a drain valve is connected to a side vessel portion at a location to maintain a predetermined minimum liquid level to ensure that the resistance heater is always immersed in liquid.

15. A refrigerant reclamation system for on-site reclamation of contaminated refrigerant comprising an upright pressure vessel for holding a predetermined portion of the contaminated refrigerant, means for pumping said contaminated refrigerant into an upper portion of said vessel, said means for pumping comprising a liquid pump and a jet pump connected to a common liquid inlet for alternatively discharging contaminated refrigerant into said pressure vessel, a liquid level control means externally mounted on said vessel for controlling said pumping means to maintain a predetermined high and low liquid level in said vessel, a sight glass provided along the side of said pressure vessel to visually monitor the liquid level, an electric resistance heater mounted in a lower portion of said vessel in pressure tight relationship therewith, a thermostatic switch having a sensing bulb mounted in said vessel above said resistance heater; and a drain valve connected to a side vessel portion at a location to maintain a predetermined minimum liquid level to ensure that said resistance heater and said sensing bulb are always immersed in liquid.

* * * * *